US008286451B2

(12) United States Patent
Mueller et al.

(10) Patent No.: US 8,286,451 B2
(45) Date of Patent: Oct. 16, 2012

(54) SPACER TEXTILE

(75) Inventors: Stefan Mueller, Wiehl (DE); Frank Mueller, Wiehl (DE)

(73) Assignee: Mueller Textil GmbH, Wiehl-Drabenderhoehe (DE)

( * ) Notice: Subject to any disclaimer, the term of this patent is extended or adjusted under 35 U.S.C. 154(b) by 0 days.

(21) Appl. No.: 12/932,721

(22) Filed: Mar. 4, 2011

(65) Prior Publication Data

US 2012/0055202 A1 Mar. 8, 2012

(30) Foreign Application Priority Data

Mar. 5, 2010 (DE) ..... 10 2010 010 524

(51) Int. Cl.
*D04B 21/00* (2006.01)

(52) U.S. Cl. ..... 66/195

(58) Field of Classification Search ..... 66/190–196, 66/170, 169 R, 172 R; 442/304, 312
See application file for complete search history.

(56) References Cited

U.S. PATENT DOCUMENTS

| | | | | |
|---|---|---|---|---|
| 3,864,944 | A * | 2/1975 | Jackson | 66/87 |
| 4,787,219 | A * | 11/1988 | Sato et al. | 66/190 |
| 5,385,036 | A * | 1/1995 | Spillane et al. | 66/87 |
| 6,244,077 | B1 * | 6/2001 | Offermann et al. | 66/195 |
| 6,477,865 | B1 * | 11/2002 | Matsumoto | 66/195 |
| 6,516,637 | B1 * | 2/2003 | Fancher et al. | 66/170 |
| 6,644,070 | B2 * | 11/2003 | Ikenaga et al. | 66/196 |
| 6,755,052 | B1 * | 6/2004 | Sytz | 66/196 |
| 7,174,749 | B2 * | 2/2007 | Ternon et al. | 66/192 |
| 7,418,837 | B2 * | 9/2008 | Muller et al. | 66/195 |

FOREIGN PATENT DOCUMENTS

| | | |
|---|---|---|
| DE | 26 26 816 | 1/1977 |
| DE | 102 60 694 | 6/2004 |
| DE | 10 2008 033 584 | 1/2010 |
| DE | 10 2008 046 437 | 3/2010 |
| EP | 1 860 218 | 11/2007 |
| GB | 1 547 464 | 6/1979 |

OTHER PUBLICATIONS

German Search Report dated Oct. 26, 2010 in German Application No. 10 2010 010 524.4 with English translation of the relevant parts.

* cited by examiner

*Primary Examiner* — Danny Worrell
(74) *Attorney, Agent, or Firm* — Collard & Roe, P.C.

(57) ABSTRACT

A spacer textile, particularly knitted spacer textile, has two cover plies spaced apart from one another, and spacer threads that connect the cover plies with one another. The cover plies are formed from a main thread system and a further thread system, forming courses that follow one another in the production direction. According to the invention, a first course is formed at least by the main thread system, and a second courses is formed by the further thread system. The thread or threads of the main thread system is/are guided without forming stitches, in the production direction, in the second course, and the cover plies have a lower tear strength there, when pulled in the production direction.

13 Claims, 2 Drawing Sheets

SPACER TEXTILE

CROSS REFERENCE TO RELATED APPLICATIONS

Applicants claim priority under 35 U.S.C. 119 of German Application No. 10 2010 010 524.4 filed Mar. 5, 2010, the disclosure of which is incorporated by reference.

BACKGROUND OF THE INVENTION

1. Field of the Invention

The invention relates to a spacer textile, particularly a knitted spacer textile, having two cover plies spaced apart from one another, and having spacer threads that connect the cover plies with one another, whereby the cover plies are each formed from a main thread system and a further thread system, forming courses that follow one another in the production direction. Another object of the invention is a laminate material for lining the interior of a motor vehicle with such a spacer textile, as well as with an applied cover layer.

2. The Prior Art

Spacer textiles having cover plies spaced apart from one another as well as spacer threads that run between them have good, uniformly pressure-elastic properties, and an overall light structure, and are therefore suitable, to a particular degree, as backing upholstery. For example, spacer textiles are used in the automotive sector for interior trim, whereby laminate materials having a spacer textile and a cover layer laminated onto it, for example leather, artificial leather, or a decorative film, can be used to line the car roof interior, the dashboard, as well as the door sides. Furthermore, it is known to use knitted spacer textiles having a relatively great compression hardness and a great density as a functional layer in climate-controlled seats or seat covers of motor vehicles.

In the use of a spacer textile as backing upholstery of dashboards, which are also called instrument panels in practice, it is necessary that the laminate of spacer textile and cover layer break open, in a controlled manner, in the event of an accident, at those locations where an air bag is disposed, so that the latter can unfold freely. Specifically in this area of the dashboard, however, visible seams, edges, or uneven areas should be avoided, for esthetic reasons.

A knitted spacer textile having the characteristics described initially, which can be torn with reduced expenditure of force at a planned parting location that runs in the production direction, when pulled in the transverse direction, is described in European Patent No. EP 1 860 218 B1. The spacer threads, which connect wales of the one cover ply with warp strings of the other cover ply, which is offset relative to the first, in a top view, in an X lapping, are omitted at the planned parting location, whereby the spacer threads have an I lapping at the wales between which the planned parting location is formed. The cover plies each have a main thread system that forms courses in the transverse direction and wales in the production direction, over the full area. A weft thread that runs in the transverse direction is provided as an additional thread system; it connects the wales and has a comparatively low tear strength. At the planned parting location, the adjacent wales are connected only by the weft thread, so that there, easy tearing of the knitted spacer textile is made possible when the textile is pulled in the transverse direction. Despite the weakening, the planned parting location is not visible underneath a cover layer of leather, artificial leather, or the like. The known knitted spacer textile has proven itself in practice as a cover for air bags. However, the precise positioning of the planned parting location, which is usually marked with a colored thread, requires increased effort in the production of an interior trim.

A knitted spacer textile that consists of a total of seven thread systems is described in German Patent No. DE 102 60 694 B4. The cover plies are each formed by two thread systems, which form stitches essentially over the entire surface. These two thread systems are omitted only at planned parting locations that run in the production direction, whereby then, a parting thread runs between adjacent strips. The disclosed production method is intended for the production of multiple elastic bandages in a common work cycle, and these are then separated in a subsequent parting process. Homogeneous behavior of the intermediate product cannot be expected.

SUMMARY OF THE INVENTION

It is therefore an object of the invention to provide a spacer textile that has uniform pressure-elastic properties, overall, and demonstrates reduced tear strength at multiple locations. In particular, it is supposed to be possible to dispose the spacer textile, in combination with a cover layer, above an air bag, without register-precise orientation of the knitted spacer textile being required.

Proceeding from a spacer textile having the characteristics described initially, this object is accomplished, according to the invention, in that a first part of the courses is formed at least by the main thread system, and that a second part of the courses is formed by the further thread system. The thread or threads of the main thread system is/are guided without forming stitches, in the second part of the courses, and the cover plies have a lower tear strength in the second part of the courses, when pulled in the production direction, than in the first part of the courses. Accordingly, the courses in which the main thread system does not form any stitches are also referred to as weakened courses, in the following.

When a stitch is pulled in the production direction, the force is distributed over multiple regions of the thread that forms the stitch, in the case of a knitted textile usually over three regions that act in parallel, so that great tensile strength is achieved in the production direction. In the second part of the courses, only stitches of the less tear-resistant further thread system are provided, which can correspondingly also be called a tear thread system. There, the threads of the main thread system are guided in the production direction without forming stitches, as an individual thread section, so that with regard to the main thread system, the tensile forces at the individual threads act only on this individual thread section, which can be torn more easily, accordingly. The weakened courses form weakened regions that run in the transverse direction, at which the cover plies can break up easily when pulled in the production direction. In order to achieve a full-area structure, in total, and to be able to produce the spacer textile on a warp-knitting machine, the stitch formation by the further thread system is provided in the second part of the courses.

Because of the recurring formation of weakened courses, a plurality of weak points that run in the transverse direction can be produced, allowing easy tearing of the spacer textile. In the case of a sufficiently close spacing of the weakened courses, the spacer textile, in combination with a cover layer, can be provided as interior trim of a vehicle, above an air bag, without any specific register-precise placement of the spacer textile being required. Thus, a course or multiple courses of the first part of the courses alternate(s) with a course or multiple courses of the second part of the courses, in a repeating sequence. It is practical if weakened and non-weakened courses are disposed in a uniform sequence, thereby forming a plurality of planned breaking locations of the spacer textile, in an equidistant manner, which allow tearing in the event of pull in the longitudinal direction.

A weakened course and a non-weakened course can alternate directly, viewed in the production direction. Furthermore, it is possible to provide a weakened course between a sequence of multiple non-weakened courses. In general, it is not necessary to have multiple weakened courses follow one another directly, even though such a configuration is not excluded.

In order for the entire spacer textile to be able to tear when pulled in the longitudinal direction, both cover plies must break open in the tear region. In order to allow this, weakened courses can lie on top of one another, in a top view, in the two cover plies. Furthermore, the weakened courses in the two cover layers can have an offset of one course, whereby then, the spacer textile tears at a slant, with a corresponding offset, when pulled in the longitudinal direction. Such an offset, which can also be greater than one course, depending on the material and the underlying mechanical requirements, leads to a more uniform structure of the spacer textile formed. The simultaneous production of weakened courses in both cover plies can be problematical in the warp-knitting process, in an individual case, also from the aspect of production technology.

As was already explained above, in the case of the further thread system intended as a tear thread system, formation of stitches is provided at least in the weakened courses. In order to obtain a uniform structure and to allow simple production, however, the further thread system can also form a stitch in every course. This is particularly practical if, as will be explained below, weakening lines that run in the longitudinal direction are also provided, which additionally allow tearing of the spacer textile when pulled in the transverse direction.

Thus, it can be provided that the spacer textile has at least one planned parting location that runs in the production direction, at which the spacer textile has a reduced tear strength in the transverse direction. For this purpose, the spacer textile can have a plurality of wales, in accordance with EP 1 860 218 B1 mentioned earlier, whereby a planned parting location that runs in the production direction is formed between two of the wales such that there, no slanted connections by the spacer threads are provided, and adjacent wales in the two cover plies are connected only by means of a tear thread or threads. In place of the weft thread described in EP 1 860 218 B1, the further thread system can be provided to connect the wales at the planned breaking location, which system connects adjacent wales in a tricot lapping, for example.

In one embodiment of the invention, the spacer textile has a plurality of planned parting locations that are formed between two wales that run in the production direction. Spacer threads are provided outside of the planned parting locations, which threads connect wales of the one cover ply with wales of the other cover ply that are offset from them, in a top view. At the planned parting locations, the spacer textile is free of such connections, which run at a slant, and can be provided in the form of an X lapping, a slanted lapping, an IXI lapping, or an N lapping, for example. Such a knitted spacer textile, having planned parting locations that allow tearing in the transverse direction, is described in German Patent Application No. DE 10 2008 046 437.6, the disclosure of which is herein incorporated by reference. The connection of adjacent wales preferably takes place, in such an embodiment, by the further thread system, which can be present in a tricot lapping, for example.

The spacer threads preferably consist of a mono-filament yarn having a thickness between 20 and 50 dtex. In order to allow even easier tearing at the weakened courses, the spacer threads can be guided without forming stitches, so that there, of the different thread systems, i.e., the main thread system and the tear thread system in the two cover layers, as well as the spacer threads that connect the cover plies, only the tear thread system forms stitches.

The main thread system of the two cover plies is preferably formed from multi-filament yarn. A comparatively soft and dense surface can be produced by multi-filament yarns, in particular, and this surface allows a large-area connection by adhesive in the case of lamination to a cover layer, without the adhesive penetrating into the interior of the spacer textile in uncontrolled manner. Yarns having a thickness between 50 dtex and 170 dtex are particularly suitable. Depending on the demands on the spacer textile, however, thicker or thinner yarns can also be used. A dense surface is generally advantageous.

The further thread system, which is supposed to allow tearing when pulled in the longitudinal direction and preferably also when pulled in the transverse direction, and accordingly is also referred to as a tear thread system, has a lower strength as compared with the main thread system. In the production and processing, however, as well as during normal use of the spacer textile as intended, the tear thread system still has to guarantee sufficient stability of the weakened courses. Like the spacer threads, the tear thread system can be formed from mono-filament yarn having a thickness preferably between 20 and 50 dtex.

The precise lapping pattern of all the thread systems, in other words the main thread system and tear thread system in the two cover plies, as well as the spacer thread system that connects the cover plies, must be selected taking the production effort and the run of the lapping pattern on the textile machine as well as the desired mechanical properties into consideration.

When using the spacer textile as backing upholstery for interior trim, threads made of plastic are preferably used, such as polyamide or polyester, or viscose, for example.

In order to achieve easy coating, for example lamination by means of adhesive, and the most uniform mechanical properties possible, the cover layers preferably have a close-mesh structure, whereby the cover layers demonstrate between 16 and 38 stitches per centimeter in the production direction and/or in the transverse direction. The total thickness of the spacer textile usually amounts to between 1 mm and 6 mm.

Also, a laminate material for lining the interior of a motor vehicle is an object of the invention, whereby the laminate material comprises the spacer textile described above, and a cover layer applied to it, which layer can be formed, for example, from leather, artificial leather, or a decorative film.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
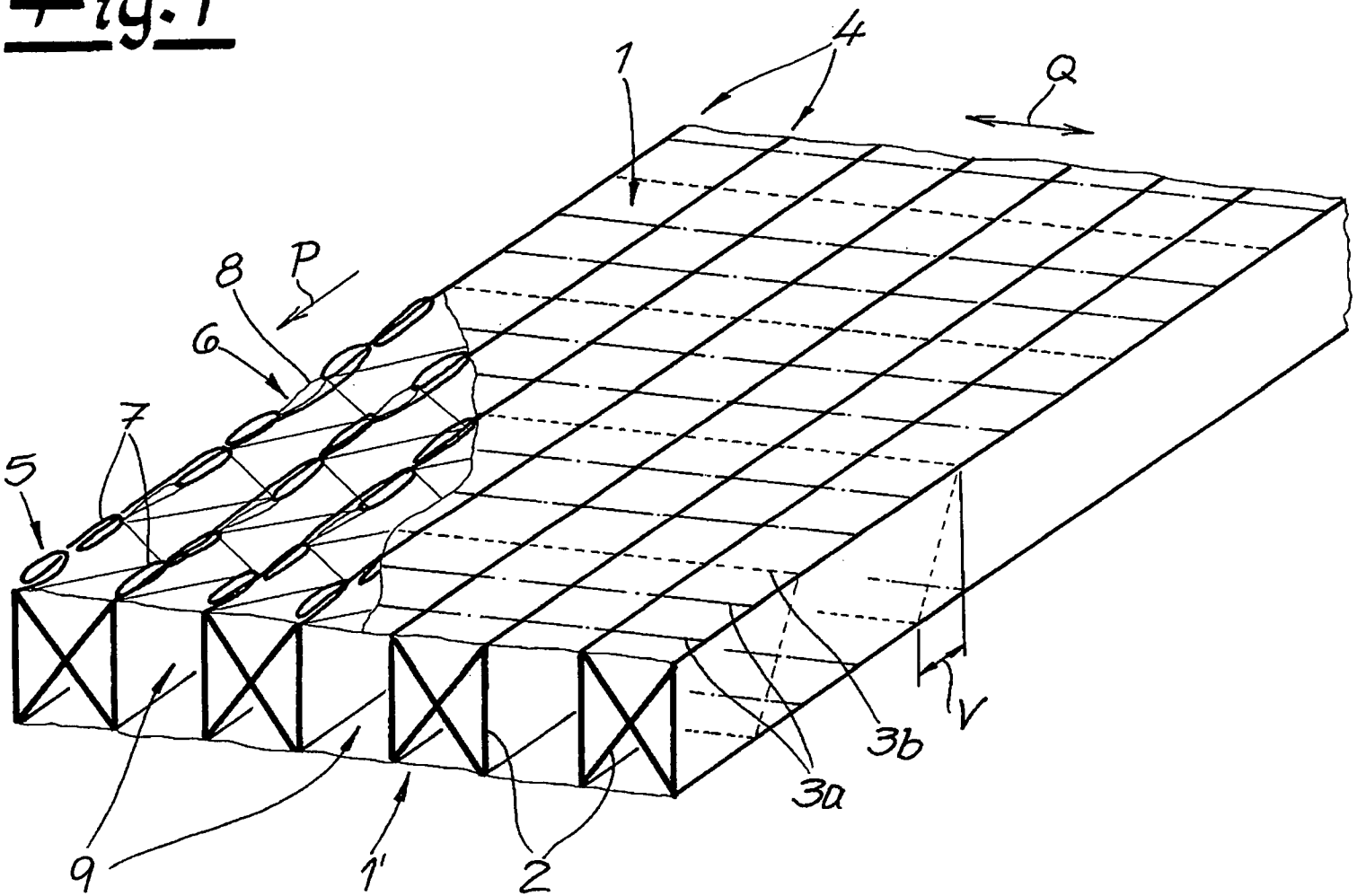
FIG. 1 shows a schematic view of a knitted spacer textile.

Referring now in detail to the drawings, FIG. 1, in a schematic view, shows a knitted spacer textile having two cover plies 1, 1' spaced apart from one another, and having spacer threads 2 that connect the cover plies 1, 1' with one another. Furthermore, it is schematically shown that cover plies 1, 1' have courses 3*a*, 3*b* that follow one another, seen in the production direction P, and run in the transverse direction Q, both in the same manner, as well as wales 4 that run in production direction P.

Figure 2:
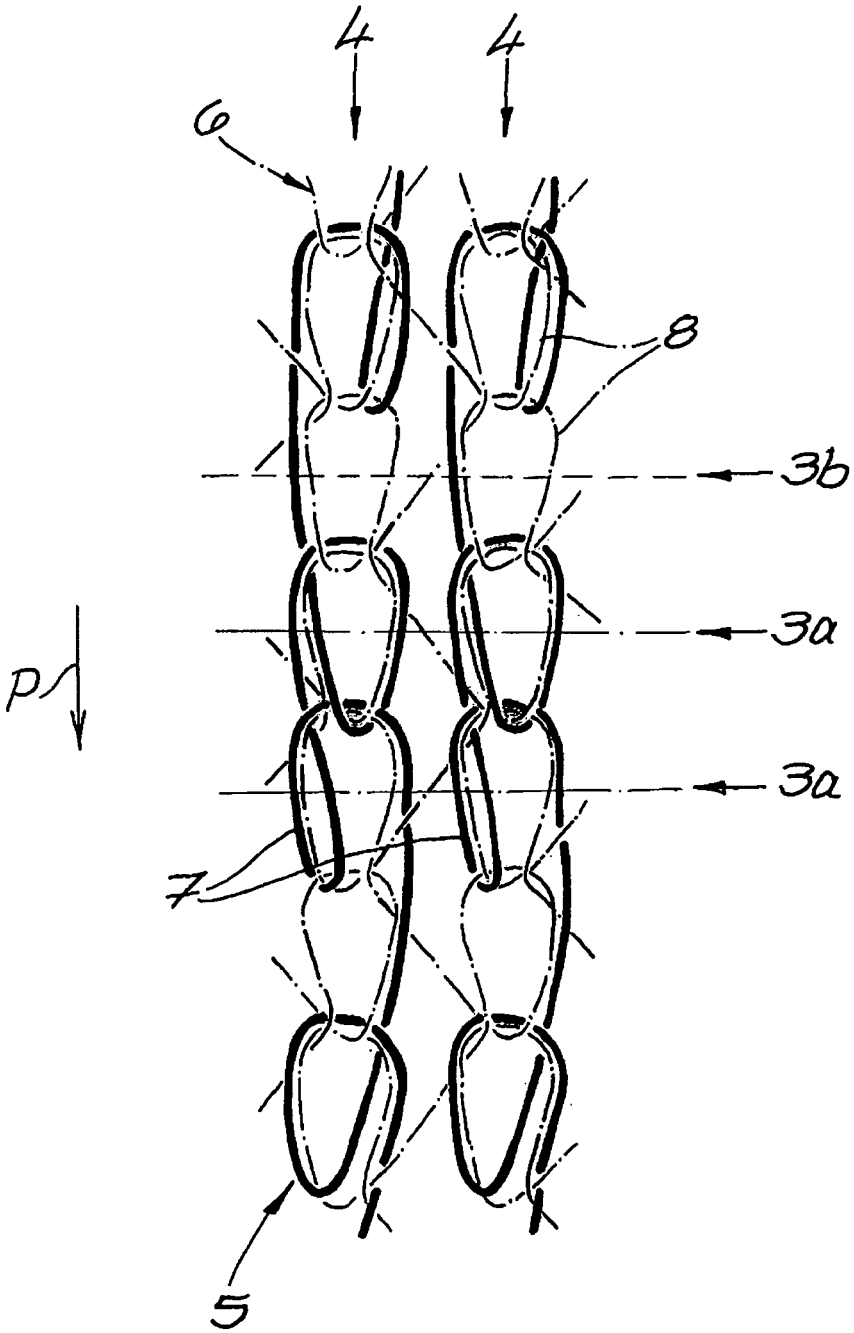
FIG. 2 shows the stitches of a main thread system and a further thread system in the cover layer of a knitted spacer textile.

Further details of the embodiment of the cover plies 1, 1' can be derived from FIG. 2, which shows individual stitches, in a small detail, which stitches are formed from a main thread system 5 and a further thread system 6.

Main thread system 5 having a plurality of threads knit in parallel is formed from a comparatively tear-resistant multi-filament yarn 7 that has a thickness between typically 50 and 170 dtex. Further thread system 6 is formed from threads that are formed from a comparatively thinner mono-filament yarn 8 that has a thickness between 20 and 50 dtex, and is disposed in a tricot lapping.

While the further thread system 6 forms a stitch in every course 3*a*, 3*b*, the main thread system 5 forms stitches only in a first part of the courses 3*a*, while the main thread system 5 is guided without forming a stitch in the production direction P in a second part of courses 3*b*.

Because of the different thread thickness, the tear strength of the two cover plies 1, 1' if they are pulled in the production direction P is essentially determined by the main thread system 5. Where stitches of main thread system 5 are provided, the forces on each stitch when pulling in the production direction P occurs are distributed over a total of three thread sections of multi-filament yarn 7, which act parallel to one another. However, where multi-filament yarn 7 of main thread system 5 is guided without forming stitches in the production direction, the forces act on only individual thread sections, and therefore the ability to absorb force is reduced. The courses 3*b* that have been weakened in this way therefore demonstrate a reduced tear resistance.

It can furthermore be derived from FIG. 2 that a weakened course 3*b*, in which the main thread system 5 does not form any stitches, follows two non-weakened courses 3*a*.

According to FIG. 1, equidistant planned breaking locations in the form of the weakened courses 3*b* are produced in the cover plies 1, 1' by this uniform sequence of the courses 3*a*, 3*b*.

In order for the entire spacer textile to tear when pull is exerted in the production direction P, both cover plies 1, 1' must have weakened courses 3*b*, which can be disposed, in a top view, either precisely one on top of the other, or, viewed in the production direction P, also with a certain offset V relative to one another. In the second case, the knitted spacer textile breaks open at a slight slant between two weakened courses 3*b* of the first cover ply 1 and the second cover ply 1' that are assigned to one another. FIG. 1 shows, as an example, an embodiment in which the weakened courses 3*b* are offset by one course in the production direction.

As can be derived from FIG. 1, the individual wales 4 in cover plies 1, 1' are only connected by the further thread system 6, which is present in a tricot lapping. In addition, spacer threads 2 shown schematically in FIG. 1 also run between cover plies 1, 1'. It can be seen that these are disposed so that a part of them, in the top view of the adjacent wales 4 of the upper cover ply 1 and the lower cover ply 1', are connected with one another. In addition to the IXI lapping shown, an X lapping, an N lapping, or a simple slanted lapping can be provided. Furthermore, it can be seen that in another part of adjacent wales 4, no such slanted connections are provided, so that the entire spacer structure of the knitted spacer textile is connected only by further thread system 6 in the two cover plies 1, 1', at these locations in the transverse direction Q. Since further thread system 6 formed from mono-filament yarn 8 has a low strength, a planned parting location 9 is formed between the wales 4 not connected by slanted spacer threads 2, which location can easily be broken open when pull is exerted in transverse direction Q.

In total, a knitted surface structure is therefore obtained, which has weakened regions, disposed equidistantly, not only in the production direction P but also in the transverse direction Q. With this, the advantage is also obtained that not only straight, but also angled tear lines can be produced. If, for example, the knitted spacer textile is disposed above an air bag, as a laminate material, together with a cover layer, reliable and reproducible tearing open can be achieved, in total. In this connection, it must be taken into consideration that many air bag systems are disposed underneath a flap, which requires tearing in two directions that are perpendicular to one another, when the flap is opened. The spacer textile according to the invention can therefore be used in particularly flexible manner.

According to a preferred embodiment, the spacer threads 2 can be formed from mono-filament yarn, which, just like the mono-filament yarn 8 of further thread system 6, usually has a thickness between 20 and 50 dtex. Fundamentally, it is possible to provide the same material for spacer threads 2, on the one hand, and further thread system 6, on the other hand. For example, yarns made of plastic, particularly polyamide and polyester, are suitable.

Accordingly, while only a few embodiments of the present invention have been shown and described, it is obvious that many changes and modifications may be made thereunto without departing from the spirit and scope of the invention.

What is claimed is:

1. A spacer textile comprising:

two cover plies spaced apart from one another, each cover ply being formed from a main thread system and a further thread system, forming first and second courses that follow one another in the production direction; and spacer threads that connect the cover plies with one another, wherein the first course is formed at least by the main thread system, and the second course is formed by the further thread system, wherein at least one thread of the main thread system is guided without forming stitches in the second course, and wherein the cover plies have a lower tear strength in the second course, in the production direction, than in the first course, wherein there are a plurality of planned parting locations at which the spacer textile has a reduced tear strength in a transverse direction, wherein the parting locations are formed between two wales that run in the production direction, wherein the spacer threads are provided outside of the planned parting locations, said threads connecting wales of the one cover ply with wales of the other cover ply that are offset from them, in a top view, and wherein the spacer textile is free of said spacer threads, which run at a slant, in the planned parting locations.

2. The spacer textile according to claim 1, wherein at least one of the first courses alternates with at least one of the second courses, in a repeating sequence.

3. The spacer textile according to claim 1, wherein the further thread system forms stitches in every course.

4. The spacer textile according to claim 1, wherein the second courses of each cover ply overlap one another, in a top view, or are offset by one course.

5. The spacer textile according to claim 1, wherein adjacent wales in the two cover plies are connected only by the further thread system in the at least one planned parting location.

6. The spacer textile according to claim 1, wherein the further thread system has a tricot lapping.

7. The spacer textile according to claim 1, wherein the spacer threads are guided without forming stitches in the second courses.

8. The spacer textile according to claim 1, wherein the main thread system of the two cover layers is formed from multi-filament yarn.

9. The spacer textile according to claim 1, wherein the further thread system is formed from mono-filament yarn having a thickness between 20 dtex and 50 dtex.

10. The spacer textile according to claim 1, wherein the spacer threads are formed from mono-filament yarn having a thickness between 20 and 50 dtex.

11. The spacer textile according to claim 1, wherein the cover plies have between 16 and 38 stitches per centimeter in at lease one of the production direction and transverse direction.

12. The spacer textile according to claim 1, wherein the spacer textile has a total thickness of between 1 mm and 6 mm.

13. A laminate material for lining the interior of a motor vehicle, comprising:

two cover plies spaced apart from one another, each cover ply being formed from a main thread system and a further thread system, forming first and second courses that follow one another in the production direction;

spacer threads that connect the cover plies with one another; and a cover layer applied to the spacer textile, wherein the first course is formed at least by the main thread system, and is formed by the further thread system, wherein at least one thread of the main thread system is guided without forming stitches, in the second course, and wherein the cover plies have a lower tear strength in the second course, in the production direction, than in the first course, wherein there are a plurality of planned parting locations at which the spacer textile has a reduced tear strength in a transverse direction, wherein the parting locations are formed between two wales that run in the production direction, wherein the spacer threads are provided outside of the planned parting locations, said threads connecting wales of the one cover ply with wales of the other cover ply that are offset from them, in a top view, and wherein the spacer textile is free of said spacer threads, which run at a slant, in the planned parting locations.

* * * * *